US005144925A

United States Patent [19]

Weiss

[11] Patent Number: 5,144,925

[45] Date of Patent: Sep. 8, 1992

[54] FUEL INJECTION DEVICE FOR FUEL-INJECTED INTERNAL COMBUSTION ENGINES

[75] Inventor: Gerhard Weiss, Marchtrenk, Austria

[73] Assignee: Automotive Diesel Gesellschaft m.b.H., Linz, Austria

[21] Appl. No.: 768,446

[22] PCT Filed: Feb. 20, 1991

[86] PCT No.: PCT/AT91/00030

§ 371 Date: Oct. 21, 1991

§ 102(e) Date: Oct. 21, 1991

[87] PCT Pub. No.: WO91/13252

PCT Pub. Date: Sep. 5, 1991

[30] Foreign Application Priority Data

Feb. 21, 1990 [AT] Austria ..... 398/90

[51] Int. Cl.[5] ..... F02B 3/00; F02M 37/04

[52] U.S. Cl. ..... 123/300; 123/500

[58] Field of Search ..... 123/500, 501, 299, 300

[56] References Cited

U.S. PATENT DOCUMENTS

| | | | |
|---|---|---|---|
| 2,159,177 | 5/1939 | Ricardo | 123/501 |
| 2,258,055 | 10/1941 | Holloway . | |
| 2,356,627 | 8/1944 | Skaredoff | 123/300 |
| 2,398,834 | 4/1946 | Kammer | 123/299 |
| 2,565,681 | 8/1951 | Fleck | 123/501 |
| 4,013,055 | 3/1977 | Sommer | 123/501 |
| 4,411,238 | 10/1983 | Ecomard | 123/501 |
| 4,448,167 | 5/1984 | Schmid | 123/503 |
| 4,630,586 | 12/1986 | Guntert | 123/500 |
| 4,754,737 | 7/1988 | Ishida | 123/501 |
| 4,975,029 | 12/1990 | Hatz | 123/300 |

FOREIGN PATENT DOCUMENTS

| | | | |
|---|---|---|---|
| 2730091 | 1/1979 | Fed. Rep. of Germany . | |
| 2922426 | 12/1980 | Fed. Rep. of Germany . | |
| 3428174 | 2/1986 | Fed. Rep. of Germany . | |
| 1164392 | 10/1958 | France | 123/501 |
| 2067883 | 11/1969 | France . | |
| 148054 | 9/1982 | Japan . | |
| 0230972 | 2/1990 | Japan . | |

*Primary Examiner*—Carl S. Miller

*Attorney, Agent, or Firm*—Cushman, Darby & Cushman

[57] ABSTRACT

In a fuel injection device for fuel-injected internal combustion engines, in which a pump piston and a pump piston bushing or a control sleeve can be turned relative to each other and the end of output is determined by at least one slanted control edge, which slides over an overflow hole of the respective other part; whereby to achieve a pre-injection and a main injection a take-up piston that is driven in a cylinder that is connected to the high pressure chamber is provided and whereby the volume released from the take-up piston determines the injection pause between pre-injection and main injection, the slanted control edge, in the area of zero output, exhibits a step that runs back in the direction of a rotation corresponding to the direction of an increase in output. The distance of the point, at which the slanted control edge changes into the recess that runs back, to the control edge that controls the start of output, is greater than the diameter of the overflow hole. Because of this step, the area of zero output is increased and displaced in the direction of increased output. In this way, the required control angle is reduced without increasing the steepness of the slanted control edge.

4 Claims, 3 Drawing Sheets

FUEL INJECTION DEVICE FOR FUEL-INJECTED INTERNAL COMBUSTION ENGINES

The invention relates to a fuel injection device for fuel-injected internal combustion engines, in which a pump piston and a pump piston bushing or a control sleeve can be turned relative to each other and the end of output is defined by at least one slanted control edge of one part which slides over an overflow hole of the respective other part, and the start of output is determined by another control edge of this part that slides over the overflow hole of the respective other part; whereby to achieve a pre-injection and a main injection, a take-up piston is provided that is driven in a take-up cylinder connected to the high pressure chamber and whereby the volume released by the take-up piston determines the injection pause between pre-injection and main injection.

When the part that can rotate, namely the pump piston or the control sleeve, is turned out of the "zero output" position by a certain control angle, in the direction corresponding to an increase in the output, the output begins and thus the pre-injection. During a control angle increase at constant speed, first the pre-injection quantity increases rapidly, after which it remains constant and at the same time the total quantity remains constant for a long time. When the dynamic opening pressure of the take-up piston is reached, the take-up piston begins to move and the take-up cylinder accepts the fuel quantity supplied. With increasing control angle, the take-up cylinder takes up more and more fuel quantity. This continues until the entire acceptance volume of the take-up cylinder has been reached. Starting from this control angle position, the main injection starts to form.

In the known arrangements, the curve of the slanted control edge is continuous. The control angle, via which the rotating part must be turned in the phase from the beginning of gradual fuel supply into the take-up cylinder until the full acceptance volume of the take-up cylinder is reached, which corresponds to the interval between pre-injection and main injection, is relatively large. Thus, a large control angle results over the entire control range, and such a large control angle causes difficulties in some actuators. During this phase, nothing in the injection behavior changes and thus there is additionally the danger that the status signal will display an error. This also represents a significant disadvantage. A reduction in the control angle could even be achieved with a steeper arrangement of the slanted control edge, but this would in turn decrease the control sensitivity.

The task of the invention is to reduce the required control angle. To fulfill this task, the invention basically consists of the fact that, in the area of zero output, the angled control edge exhibits a recess that runs back in the direction of rotation that corresponds to an increase in the output, and that the distance from the point, at which the slanted control edge changes into the recess that runs back, to the control edge controlling the start of the output, is larger than the diameter of the overflow hole. Because of this recess, the "zero output" rotation is displaced in the direction of the rotation corresponding to an increase in output. The rotational angle between the rotation corresponding to "zero output" at maximum engine speed and the rotation corresponding to idle is reduced. In this way, the control angle is also reduced in the phase between the beginning of fuel overflow into the take-up cylinder until the full acceptance volume of same is reached. It is even possible to reduce this control angle to zero at a preset engine speed. In this way, a significant reduction of the entire control angle is achieved over the entire control range.

When the control edge area moves over the overflow hole, the output is ended. This applies both to idle and to the load cycle. Since the distance from the point, at which the slanted control edge changes into the recess that runs back, to the control edge controlling the start of output, is greater than the diameter of the overflow hole, there results an effective stroke in all rotation positions between the closure of the overflow hole and when it is passed over, which also insures the output quantity required during idle. If this distance were the same or smaller than the diameter of the overflow hole, the output quantity would be take-up by the take-up cylinder and no main injection would develop.

According to the invention, in order to form this recess, the angled control edge can run back in the form of a step. A step of this type can be machined into the slanted control edge with no problem. According to a preferred embodiment of the invention, the area of the control edge that forms the step runs in the direction of the pump piston axis. During zero output, the step makes the flow into the overflow hole possible just before an output occurs. During the transition to output, the step edge covers the overflow hole, whereby the required sealing slot is to be taken into account. After the start of the output, according to a stroke determined by the rotation position, the slanted area of the control edge changes into the slanted area of the shutoff edge, whereby the output is ended. Because of the fact that the step runs in the direction of the pump piston axis, the required sealing slot is maintained during the pump piston stroke and thus a more precise start of the output and/or the idle output is made possible. Apart from this, the fact that the step runs in the direction of the pump piston axis makes machining it in during production easier.

According to the invention, the recess and/or step of the slanted control edge extends so far that during idle setting the required sealing slot width is assured between the edge that delimits the recess and/or the step and the shut off hole. Here as well the fact that the step runs in the direction of the pump piston axis has a favorable effect, since at the various stroke positions of the piston in the area of this step, the sealing slot remains the same. Thus, the control angle between the "zero output" setting and the idle setting can be kept to a minimum because of this recess and/or step, without an adverse effect on the required sealing slot.

In the drawing, the invention is explained schematically using example embodiments.

Figure 1:
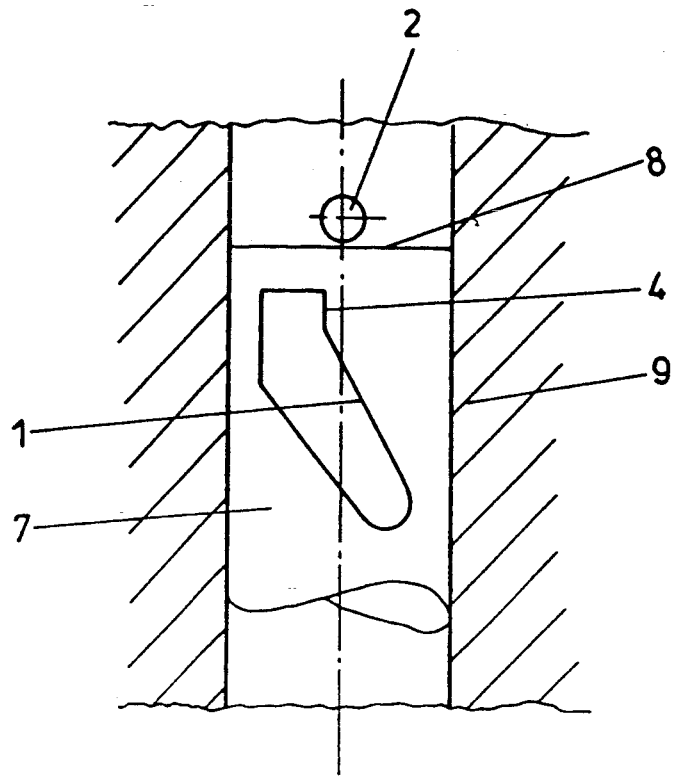
FIG. 1 shows a side view of the piston.
Figure 2:
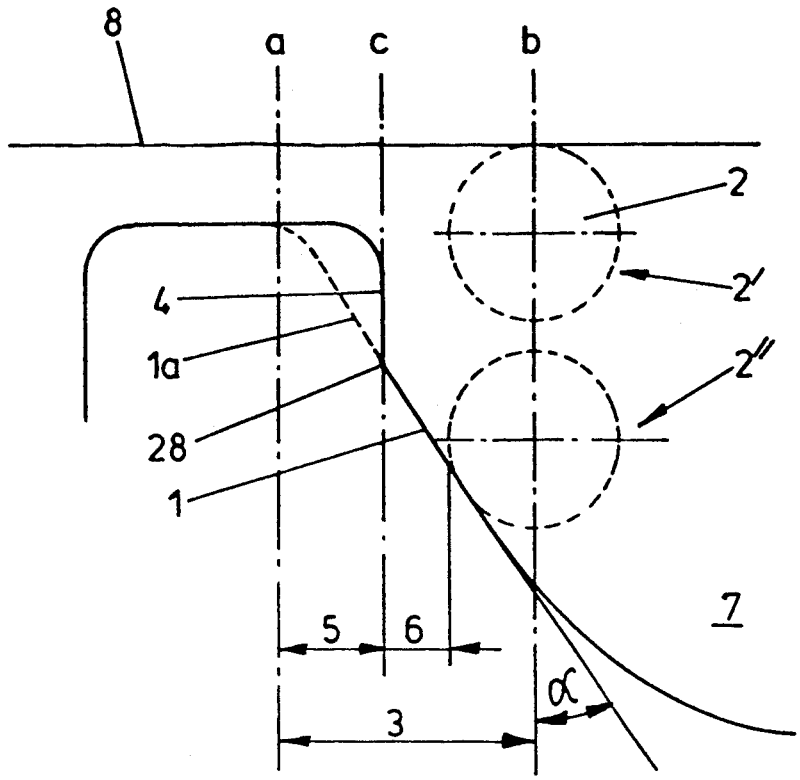
FIG. 2 shows a developed view of the piston shroud with the slanted control edge.

In FIG. 2, the slanted control edge of the pump piston shown in FIG. 1 is shown in larger scale. The piston 7 exhibits a slanted control edge 1, which is passed over by the overflow hole 2. In the known versions, the slanted control edge runs along a continuous curve, as is indicated in area la in dotted lines. In a known version of this type, in which the control edge 1–1a runs along a continuous curve, the relative position of the overflow hole lies at zero output in line a. The relative position of the overflow hole 2 during idle is in line b. The position 2' of the overflow hole 2 shows the start of output and the setting 2'' shows the end of output. The control angle 3 between the setting (a) "zero output" and the idle setting (b) is thus relatively large in the known version.

In the version according to the invention, the control edge runs along an uneven curve. The lower control edge 1 exhibits a step 4, which runs in the direction of the piston axis. The lower control edge now runs along line 1–4. In this way, the "zero output" setting is moved by a value of 5 in the direction of line (b) and now lies in line (c). The control angle is thus reduced by area 5. The required sealing slot between the overflow hole 2 in the idle setting line (b) and the control edge area forming step 4 is indicated with 6. Thus it can be seen that the entire control angle is reduced by area 5. In this way, it is possible to get by with a control angle of about 60°.

The upper edge 8 of the piston 7 represents the upper control edge, which slides over the overflow hole 2 in the pump piston bushing 9 during the start of output.

As FIG. 2 shows, the distance from position 28, at which the slanted control edge 1 changes into step 4 that runs back, to the upper control edge 8 that controls the start of output, is greater than the diameter of the overflow hole.

This results in an effective stroke from the piston setting at which the upper control edge 8 closes the overflow hole 2 (start of output), up to the piston setting at which the slanted control edge 1 releases the overflow hole 2 (end of output).

Figure 3:
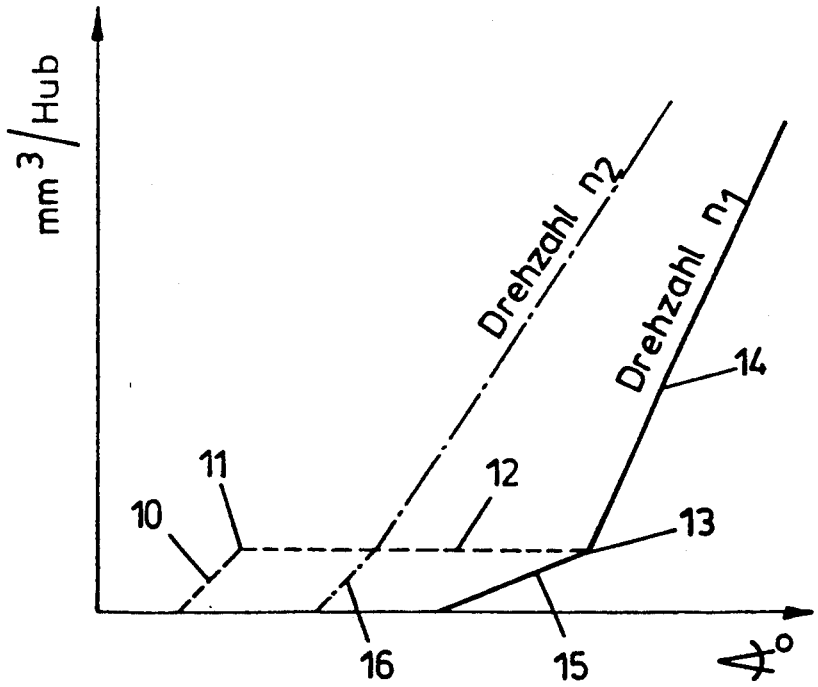
FIG. 3 shows a diagram in which the injection quantity is entered on the ordinate and the control angle on the abscissa.

The diagram according to FIG. 3 shows the effect of this reduction in the control angle. The ordinate shows the injection quantity in $mm^3$ per stroke and the abscissa shows the control angle. In the known versions, in which t he control edge 1–1a runs along a continuous curve, the curve 10 shows the development of pre-injection. At point 11, the full magnitude of the pre-injection is reached and/or the opening pressure of the take-up piston is achieved. After this, the take-up movement of the take-up piston begins over a significant control angle. This is indicated by curve 12. At point 13, the take-up piston has released the complete absorption volume of the take-up cylinder and the main injection begins. The curve 14 corresponds to the increase in main injection at a pre-set constant engine speed and displays the amount of the total injection quantity. This is the curve in the known versions.

The control angle is reduced by step 4. In this way, the phase indicated by curve 12 is reduced. At a specified constant engine speed selected for the diagram according to FIG. 3, this phase of curve 12 is even reduced down to zero. In this case, the pre-injection runs along curve 15, until the complete pre-injection is reached at point 13. After the injection pause determined by the absorption volume of the take-up cylinder, the main injection forms according to curve 14. The absolute values in $mm^3$ to be read on the ordinates display the total injection quantity. This is true at an assumed engine speed $n_1$. At other engine speeds, the pre-injection and the main injection are formed, for example, according to $n_2$.

With smaller values of 5 (FIG. 2), the reduction of the phase indicated by curve 12 can be smaller and the pre-injection can be formed, for example along curve 16. However, a reduction in the control angle in the phase indicated by curve 12 results without the increase angle of slanted control edge 1 being reduced.

Figure 4:
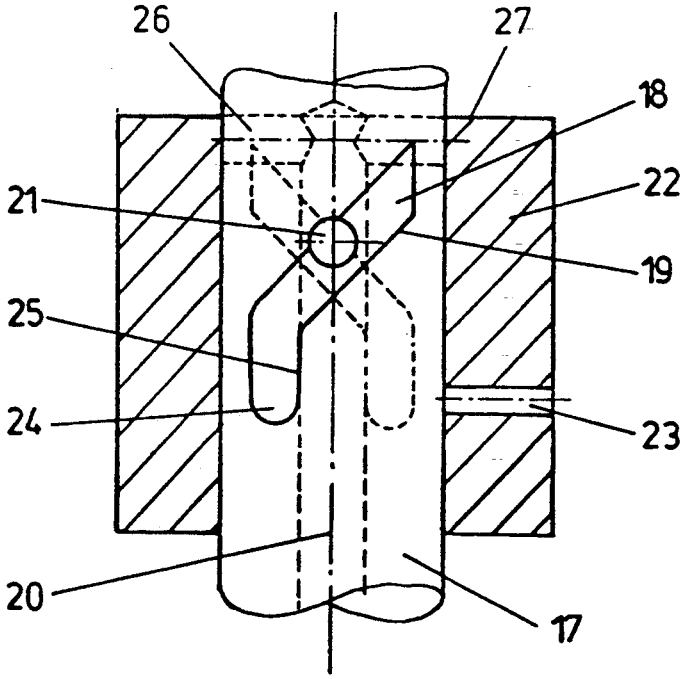
FIG. 4 shows a modified embodiment.

FIG. 4 shows a modified embodiment. The piston 17 exhibits slanted slots 18, on which the lower control edge 19 ends the output. These slanted slots 18 are connected to the working chamber of the pump piston 17 by an axial hole 20 and a transverse hole 21 and the control is caused by a control sleeve 22, which exhibits the overflow hole 23. A recess 24 that extends in the piston axial direction is placed on the slanted slot 18, whereby a step 25 of the control edge 19 is formed which has the same function as the step 4 according to FIG. 2. The start of output occurs when the edge 27 of control sleeve 22 slides over the transverse hole 26.

Figure 5:
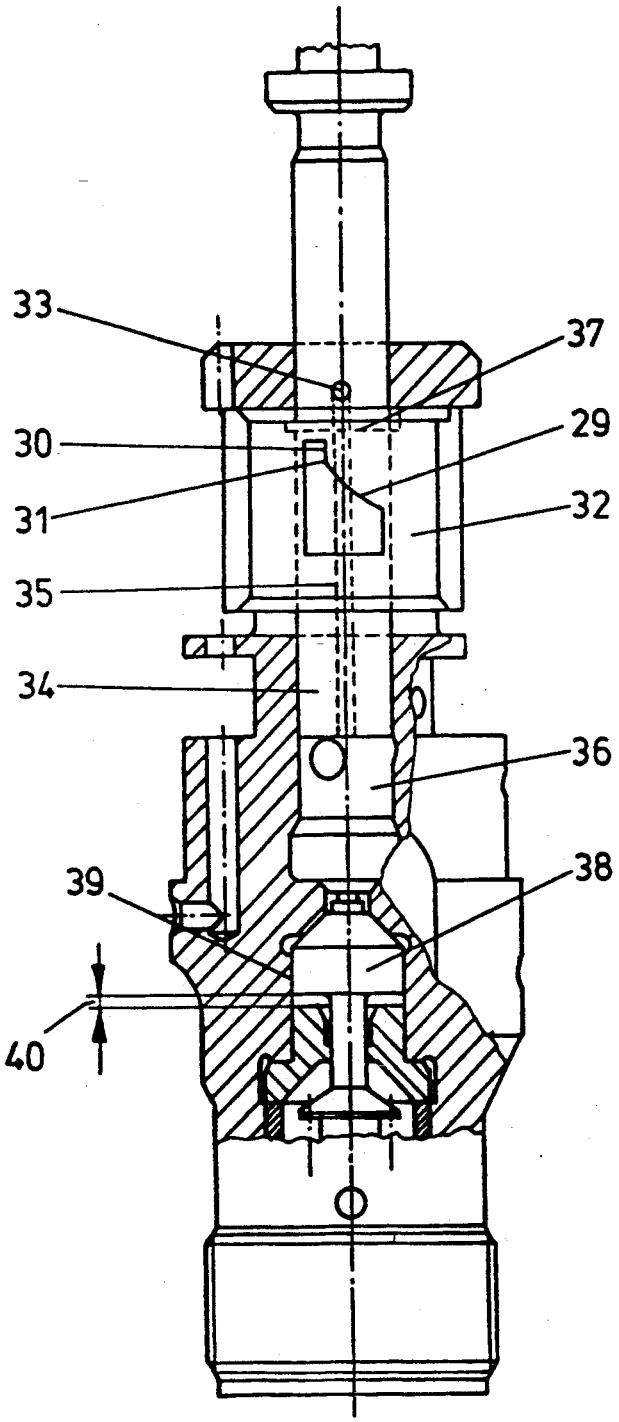
FIG. 5 shows a different embodiment example.

In the example embodiment according to FIG. 5, the slanted control edge 29 and the step 30, which the slanted control edge 29 changes into at point 31, is provided in a sleeve 32 surrounding the piston. The overflow hole 33 is provided in the piston 34 in this example embodiment and connected to the working chamber 36 by a central hole 35 in the piston 34. The output starts when the upper control edge 37 of the sleeve 32 slides over the overflow hole 33 and ends when the slanted control edge 29 of the sleeve 32 releases the overflow hole 33 of the piston 34. Here as well, the distance between the point 31, at which the slanted control edge 29 changes into the step 30, to the control edge 37 that controls the start of output is larger than the diameter of the overflow hole 33. 38 is a take-up piston which is guided in a take-up cylinder 39. The take-up stroke of the take-up piston 38 is indicated with 40.

I claim:

1. Fuel injection device for fuel-injected internal combustion engines, in which a pump piston and a pump piston bushing or a control sleeve can be turned relative to each other and the end of output is determined by at least one slanted control edge of one part which slides over an overflow hole of the respective other part, and the start of output is determined by another control edge of this part that slides over the overflow hole of the respective other part; whereby to achieve a pre-injection and a main injection, characterized by the fact that the slanted control edge (1,19,29) in the area (c) of zero output exhibits a recess (4,25,30) that runs back in the direction of rotation that corresponds to an increase in the output, and that the distance from the point (28,31) at which the slanted control edge (1,19,29) changes into the recess that runs back (4,25,30) to the control edge (8,37) that controls the start of output is greater than the diameter of the overflow hole (2,32).

2. Fuel injection device according to claim 1, characterized by the fact that for forming the recess, the slanted control edge (1,19,29) runs back in the form of a step (4,25,30).

3. Fuel injection device according to claim 2, characterized by the fact that the area of the control edge (1,19,29) that forms the step (4,25,30) runs in the direction of the pump piston axis (7,17,34).

4. Fuel injection device according to claim 1, 2 or 3, characterized by the fact that the recess and/or step (4,25,30) of the slanted control edge (1,19,29) extends so far that at idle setting (b) the required sealing slot width is assured (6) between the edge delimiting the recess and/or step (4,25,30) and the shut off hole (2,33).

* * * * *